United States Patent [19]

Tax

[11] 4,016,974

[45] Apr. 12, 1977

[54] PACKAGE FOR TRANSPORTING UNITS OF A MODULAR CRANE

[76] Inventor: Hans Tax, Potsdamer Str. 3, D-8 Munich 40, Germany

[22] Filed: Oct. 23, 1975

[21] Appl. No.: 625,307

[30] Foreign Application Priority Data

Nov. 8, 1974 Germany ..... 2453166

[52] U.S. Cl. ..... 206/321; 206/335; 206/527; 294/67 D

[51] Int. Cl.[2] ..... B65D 85/46; B65D 85/68

[58] Field of Search ..... 206/527, 321, 335; 294/67 D, 67 DA, 67 DB

[56] References Cited

UNITED STATES PATENTS

| | | | |
|---|---|---|---|
| 3,415,367 | 12/1968 | Lynch | 206/321 |
| 3,650,416 | 3/1972 | Bodenheimer | 206/335 |
| 3,792,558 | 2/1974 | Berce et al. | 206/321 |

*Primary Examiner*—Stephen P. Garbe
*Assistant Examiner*—Douglas B. Farrow
*Attorney, Agent, or Firm*—Hans Berman

[57] ABSTRACT

The disassembled tower and/or boom units of a modular construction crane are arranged in packages for handling by container equipment by means of rectangular frames releasably attached to the two longitudinal end portions of each unit and equipped with the conventional couplings of a shipping container of standard dimensions.

4 Claims, 3 Drawing Figures

PACKAGE FOR TRANSPORTING UNITS OF A MODULAR CRANE

This invention relates to cranes of modular construction, and more particularly to a package for transporting the units of the disassembled crane.

The cranes temporarily employed at construction sites are usually too big to be transported to and from the site in one piece. It is customary to assemble the crane tower and also the boom from individual, modular units, usually elongated lattice girders. Even these units are bulky and difficult to handle. They require special lifting and transporting devices carefully matched to the dimensions and the weight of each crane unit if damage to the units is to be safely avoided. When the units are to be transported by barges or other ships, they must be secured on the deck of the vessel and must not be loaded together with other freight because of their relatively low strength under localized transverse compression.

It is an important object of this invention to provide a package including one or more crane units which can be handled conveniently by normally available container equipment and protects the unit or units against damage by other freight on the same vessel.

With this object and others in view, as will hereinafter become apparent, a rigid, rectangular frame is releasably attached to each longitudinal end portion of the crane unit to be transported in a plane transverse to the direction of unit elongation. Couplings at the four corners of each frame permit the entire package to be coupled to conventional container handling apparatus, the term "container", as used in this specification and the appended claims, referring to the prismatic shipping containers of internationally standardized dimensions, typically several meters in length and width, of the type transported by container ships and analogous vehicles travelling over roads or rails. The standard dimensions of such containers are listed, for example, in tentative German Industrial Standard DIN 15190, sheet 1.

The package may be handled like any conventional container by equipment commonly available, and the package may be stacked below the deck of a ship with containers of the usual sealed type, the rigid end frames carrying the weight of superposed loads. It is necessary that the crane units be dimensioned so that the packages will conform to standard container lengths. The units must have adequate rigidity not to buckle under their own weight when handled by the usual container equipment coupled to the end frames, and this requirement is normally met by sections of modular cranes which constitute the sole load bearing longitudinal connections between pairs of attached frames.

It is often possible to accomodate more than one crane unit between a pair of end frames, as by arranging a boom unit within the lattice girder structure of a tower unit. If the cross section of the tower is greater than that of the largest permissible end frame, the tower unit may have to be disassembled into generally flat wall sections which then may be arranged between two end frames connected by a boom section.

Each unit of a modular crane is normally equipped with fasteners for attaching the unit of approximately identical units in longitudinal alignment. These fasteners readily lend themselves to the task of releasably fastening the unit to the associated end frames.

Other features, additional objects, and many of the attendant advantages of this invention will readily be appreciated as the same becomes better understood by reference to the following detailed description of preferred embodiments when considered in connection with the appended drawing in which.

Figure 1:
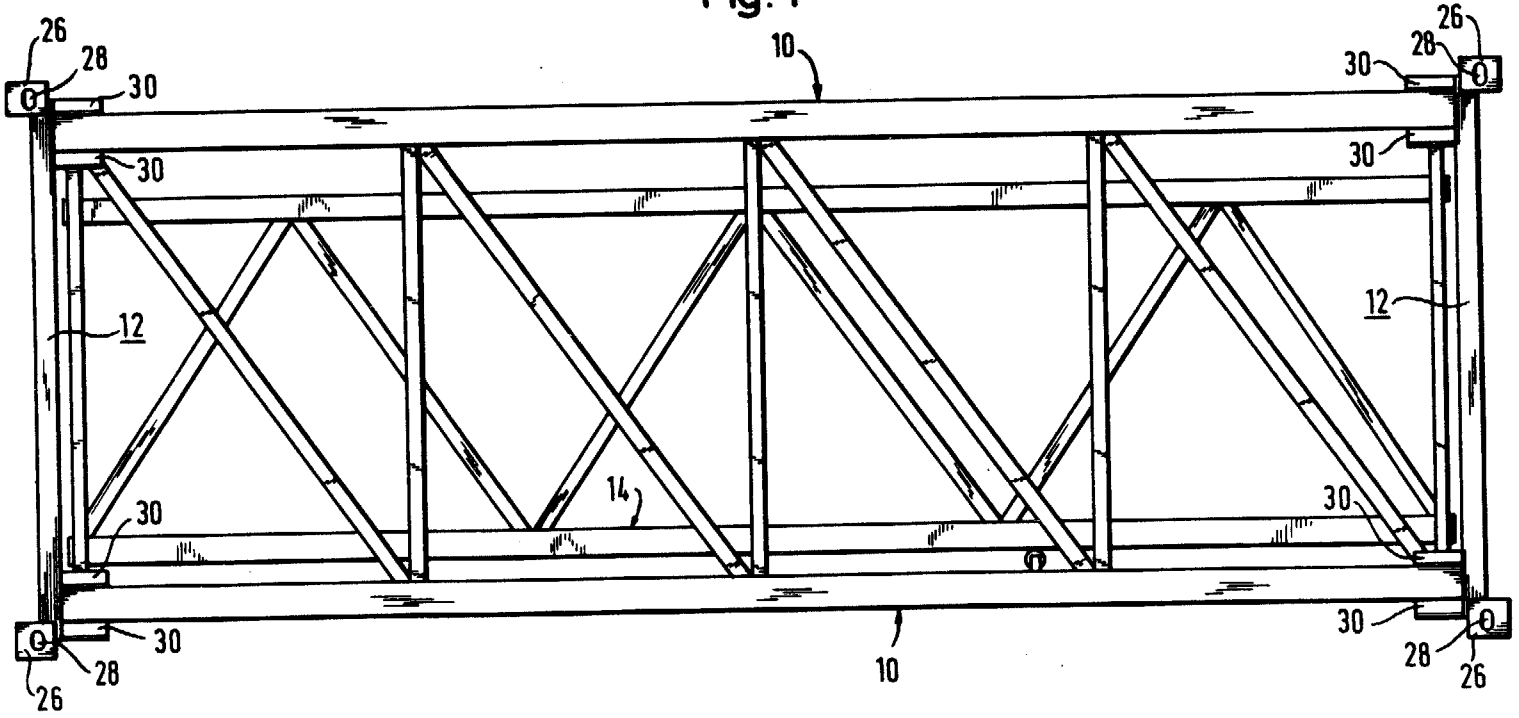
FIG. 1 shows a package according to the invention in side elevation.
Figure 2:
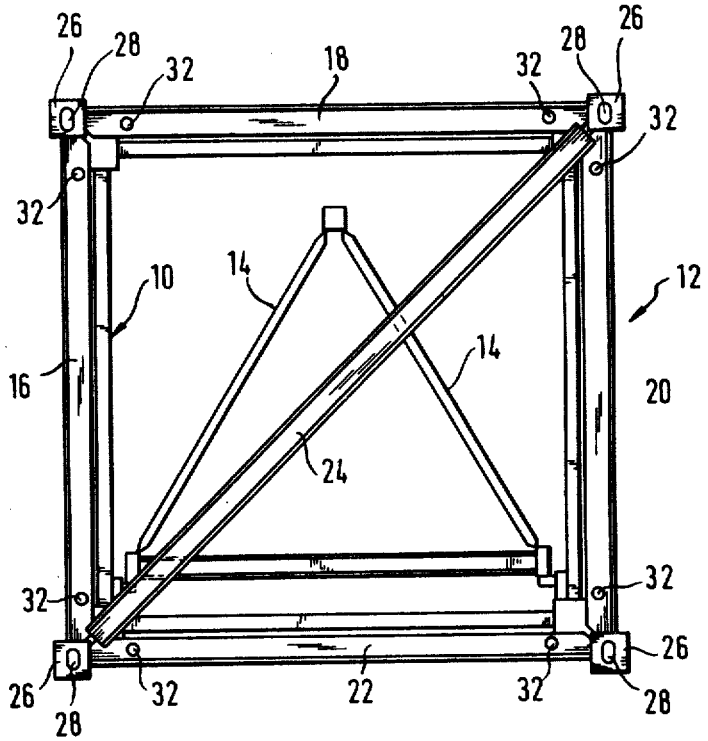
FIG. 2 illustrates the package of FIG. 1 in front elevation.

Referring initially to FIGS. 1 and 2, there is shown a crane tower unit 10 which is a lattice girder of square cross section. A rigid frame 12 is releasably fastened to each longitudinal end portion of the unit 10, and a boom unit 14 of triangular cross section is secured within the interior of the tower unit 10 in a manner not specifically shown.

Each of the frames 12 essentially consists of four channels 16, 18, 20, 22 arranged in a rectangular pattern and reinforced by a diagonal strut 24, the channels and the strut being welded to each other. The four corners of each frame 12 carry fittings 26 of the type commonly employed on shipping containers which permit the frame 12 to be coupled to matching cooperating fittings on container handling equipment, the four corners of each frame 12 being aligned with corresponding corners of the other frame in the direction of elongation of the units 10, 14. The illustrated fittings 26 are of prismatic outline and provided with apertures 28 in three exposed faces for cooperation with inserted coupling elements of container lifting devices and the like, such fittings being conventional and standardized. It is not necessary that the transported crane units be of any specific cross sectional shape or dimension to match them to the handling apparatus.

The fastening devices which connect the several crane units in the assembled crane are utilized to advantage in attaching the end frames 12 to the units. The tower unit 10 carries two sleeves 30 on each end of its longitudinal members. In assembling the tower, threaded rods are passed through longitudinally adjacent sleeves of two units, and are secured by nuts. In the package shown in FIGS. 1 and 2, a bolt, not shown, passes through each sleeve 30 and an aligned bore 32 in the frame 12. The head of the bolt and a non-illustrated nut on the bolt abut against respective surfaces of the sleeve 30 and of the frame 12 to fasten the frame 12 to the unit 10. The triangular boom unit 14 may be fastened in a similar manner, but may also be attached to the tower unit 10 in any other desired manner. Crane units assembled by means of fastening elements other than the sleeves 30 may obviously be fastened to associated end frames 12 by their fastening elements.

Figure 3:
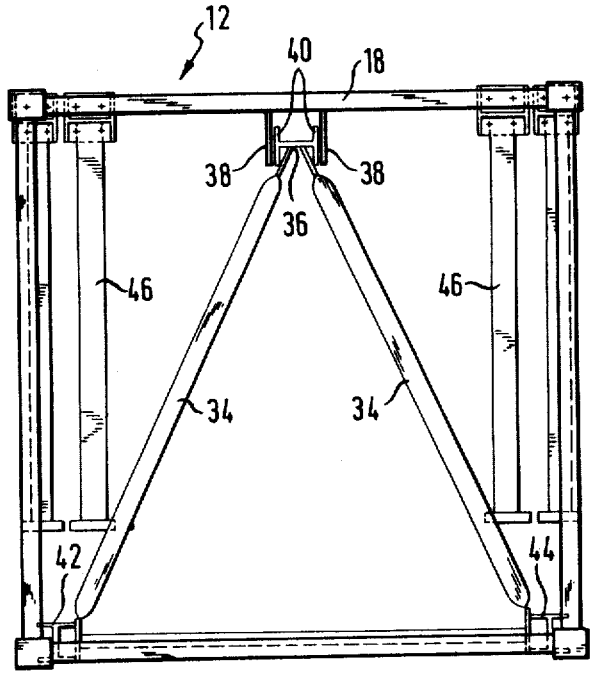
FIG. 3 shows another package of the invention in a view corresponding to FIG. 2.

In the modified embodiment of the invention illustrated in FIG. 3, two end frames 12 of the type described above are attached to the two longitudinal end portions of a boom unit 34 of triangular cross section. The end frames are attached to the upper cord 36 of the boom unit 34 by means of two integral flanges 38 depending from the channel 18 and receiving therebetween a fastening lug 40 integral with the boom unit 34, the channels and lug being releasably connected by bolts and nuts, not shown. Bolts, not shown, similarly connect the frames 12 to the lower cords 42, 44 of the boom unit 34.

The frames 12 define the loading space occupied by the package, and this space is utilized in the package of FIG. 3 to receive flat wall sections 46 of a tower unit too wide in cross section to fit into the largest standard container dimensions without being broken down into smaller units. Obviously, other crane elements may be secured within spaces available in the prismatic space between the end frames.

If individual crane tower or crane boom sections are relatively short, two or more may be left longitudinally connected as a unit and provided with end frames to convert them into a package which is the equivalent of a shipping container and may be handled with all the convenience and other advantages well known in the processing of shipping containers.

It should be understood, of course, that the foregoing disclosure relates only to preferred embodiments of the invention, and that it is intended to cover all changes and modifications of the examples of the invention herein chosen for the purpose of the disclosure which do not constitute departures from the spirit and scope of the invention set forth in the appended claims.

What is claimed is:

1. A package comprising:

a. an elongated unit of a modular crane having two longitudinal end portions;

b. fastening means on said longitudinal end portions of said unit for fastening the unit to two other substantially identical units in longitudinal alignment;

c. a rectangular frame releasably attached to each longitudinal end portion of said unit by said fastening means in a plane transverse to the direction of elongation of said unit; and d. coupling means on each of the four corners of each frame for coupling said frame to container handling apparatus.

2. A package as set forth in claim 1, wherein said unit constitutes the sole, load bearing connection between the frames respectively attached to the longitudinal end portions of said unit.

3. A package as set forth in claim 1, wherein said unit is a lattice girder, the four corners of one of said frames being aligned with the four corners of the other frame in said direction.

4. A package as set forth in claim 3, wherein said unit is a tower unit of rectangular cross section, the package further comprising a boom unit of said crane received in said tower unit.

* * * * *